US005596182A

United States Patent [19]

Edwards et al.

[11] Patent Number: 5,596,182

[45] Date of Patent: Jan. 21, 1997

[54] ICEMAKER

[75] Inventors: James D. Edwards, Brentwood, Tenn.; Paul R. Staples, Cub Run, Ky.; David R. Whited, Brentwood, Tenn.

[73] Assignee: France/Scott Fetzer Company, Fairview, Tenn.

[21] Appl. No.: 188,195

[22] Filed: Jan. 28, 1994

[51] Int. Cl.[6] ..... F25C 5/18; H01H 43/00

[52] U.S. Cl. ..... 200/61.2; 200/38 R; 62/137; 62/233

[58] Field of Search ..... 29/854; 62/233, 62/353, 137, 127, 298, 135, 351, 344, 347, 833, 66, 340, 155, 234; 192/56; 200/38 R, 38 B, 38 BA, 38 C, 38 CA, 38 D, 61.2, 61.21; 219/331, 517; 279/79; 340/246; 403/329; 439/27

[56] References Cited

U.S. PATENT DOCUMENTS

| | | | |
|---|---|---|---|
| 908,117 | 12/1908 | Murray . | |
| 2,717,500 | 9/1955 | Ploeger | 62/7 |
| 2,717,501 | 9/1955 | Andersson | 62/7 |
| 2,717,504 | 9/1955 | Knerr | 62/7 |
| 2,784,563 | 3/1957 | Baker | 62/7 |
| 2,799,144 | 7/1957 | Barton | 62/7 |
| 2,806,357 | 9/1957 | Pichler | 62/7 |
| 2,869,060 | 1/1959 | Chace | 318/37 |
| 2,941,378 | 6/1960 | Nelson | 62/73 |
| 2,949,749 | 8/1960 | Reddi | 62/137 |
| 2,955,442 | 10/1960 | Loewenthal | 62/351 |
| 2,976,697 | 3/1961 | Dahl | 62/137 |
| 2,981,079 | 4/1961 | Fink | 62/353 |
| 3,034,312 | 5/1962 | Harle | 62/135 |
| 3,045,444 | 7/1962 | Todd | 62/137 |
| 3,143,863 | 8/1964 | Nelson | 62/72 |
| 3,144,078 | 8/1964 | Morton et al. | 165/30 |
| 3,206,565 | 9/1965 | Lingenfelter | 200/28 |
| 3,208,233 | 9/1965 | Linstromberg | 62/137 |
| 3,213,216 | 10/1965 | Beck | 200/36 |
| 3,234,750 | 2/1966 | Swanson | 62/137 |
| 3,276,225 | 10/1966 | Linstromberg | 62/353 |
| 3,299,656 | 1/1967 | Linstromberg et al. | 62/233 |
| 3,306,065 | 2/1967 | Fox | 62/177 |
| 3,327,493 | 6/1967 | Jacobus | 62/137 |
| 3,359,382 | 12/1967 | Hendry | 200/37 |
| 3,359,747 | 12/1967 | Linstromberg | 62/135 |
| 3,362,182 | 1/1968 | Walker | 62/137 |
| 3,396,552 | 8/1968 | Buchser | 62/233 |
| 3,407,619 | 10/1968 | Walker | 62/137 |
| 3,503,222 | 3/1970 | Dinger et al. | 62/137 |
| 3,540,227 | 11/1970 | Eyman, Jr. et al. | 62/137 |
| 3,558,834 | 1/1971 | Zielke | 200/11 |
| 3,581,024 | 5/1971 | Meyer | 200/11 |
| 3,613,389 | 10/1971 | Ohlsson et al. | 62/137 |
| 3,648,476 | 3/1972 | Linstromberg | 62/137 |
| 3,675,437 | 7/1972 | Linstromberg | 62/137 |
| 3,779,032 | 12/1973 | Nichols | 62/233 |
| 3,852,542 | 12/1974 | Rogers et al. | 200/31 R |
| 3,911,691 | 10/1975 | Kohl et al. | 62/137 |
| 3,926,007 | 12/1975 | Braden et al. | 62/137 |
| 4,142,378 | 3/1979 | Bright et al. | 62/135 |
| 4,218,593 | 8/1980 | Mayer et al. | 200/11 |
| 4,530,543 | 7/1985 | Keane | 301/63 |

(List continued on next page.)

*Primary Examiner*—Cassandra C. Spyrou
*Assistant Examiner*—Michael A. Friedhofer
*Attorney, Agent, or Firm*—Wood, Herron & Evans, P.L.L.

[57] ABSTRACT

An improved icemaker having a number of features, including: a dual-activated feeler bar switch which combines the motion of two cams to operate a single switch; an adjustable-duration water fill switch which is closed by rotating a connector between two contacts; switches mounted to make wiping contact so as to clean the contact area; a combination deflector which not only deflects ice removed by the ejector from the ice mold, but also supports and lifts a feeler bar to determine whether the ice storage bin is full; a clutch mounted between the motor and ejector bar to permit slip therebetween so as to avoid stalling the motor as the ejector bar presses upon ice in the mold; a manual start button for starting the motor, simplifying installation; and an anti-back mechanism in the icemaker drive train to prevent an installer from damaging the icemaker by rotating it backwards.

19 Claims, 11 Drawing Sheets

U.S. PATENT DOCUMENTS

| | | | |
|---|---|---|---|
| 4,551,589 | 11/1985 | Bowling | 200/38 A |
| 4,604,504 | 8/1986 | Stout et al. | 200/38 B |
| 4,614,088 | 9/1986 | Brooks | 62/137 |
| 4,628,698 | 12/1986 | Needham et al. | 62/137 |
| 4,649,712 | 3/1987 | Tate, Jr. et al. | 62/137 |
| 4,649,717 | 3/1987 | Tate, Jr. et al. | 62/340 |
| 4,649,718 | 3/1987 | Linstromberg et al. | 62/340 |
| 4,659,157 | 4/1987 | Nigg et al. | 339/18 |
| 4,665,708 | 5/1987 | Tate, Jr. et al. | 62/66 |
| 4,697,432 | 10/1987 | Cole | 62/233 |
| 4,706,465 | 11/1987 | Searl | 62/137 |
| 4,728,759 | 3/1988 | Nigg et al. | 200/259 |
| 4,756,165 | 7/1988 | Chestnut et al. | 62/135 |
| 4,767,896 | 8/1988 | Nigg et al. | 200/67 |
| 4,787,216 | 11/1988 | Chesnut et al. | 62/347 |
| 4,799,362 | 1/1989 | Chestnut | 62/127 |
| 4,800,731 | 1/1989 | Cole | 62/233 |
| 4,833,894 | 5/1989 | Chesnut | 62/135 |
| 4,835,978 | 6/1989 | Cole | 62/137 |
| 4,838,026 | 6/1989 | Searl | 62/137 |
| 4,866,948 | 9/1989 | Cole | 62/233 |
| 4,872,318 | 10/1989 | Klemmensen | 62/137 |
| 4,892,983 | 1/1990 | Bogda et al. | 200/38 R |
| 4,912,939 | 4/1990 | Obermann et al. | 62/233 |

ICEMAKER

FIELD OF THE INVENTION

The present invention relates to domestic icemakers.

BACKGROUND OF THE INVENTION

A typical icemaker mounted in the freezer compartment of a domestic refrigerator will make about one harvest of cubes per hour. The typical icemaker includes a timing motor, a valve for admitting water into the ice mold to form ice, a thermostatic switch in thermal communication with the ice mold, a heater for partially melting the ice so that it will release from the mold, and an ejector bar with fingers for ejecting cubes from the mold.

A typical harvest cycle begins with the timing motor running. During a water fill period defined by the motion of the timing motor, a predetermined quantity of water flows into the mold. After the mold is filled to the desired level, the timing motor shuts off, initiating a freezing period. The ice freezing period ends when the thermostatic switch changes state, indicating that the water has frozen to ice. The thermostatic switch turns the timing motor on. The motion of the timing motor turns the heater on and rotates the ejector bar until the fingers contact the ice. The timing motor then stalls in this position, the stall torque of the motor putting continued pressure on the ice in the mold. As soon as the heater has sufficiently melted the ice to release it from the mold, the fingers begin moving and eject the ice from the mold and into the storage bin.

Once ice has been ejected into the bin, a feeler mechanism associated with the bin generates a signal to initiate a new cycle and form more ice if the bin is not full.

Despite numerous prior units, there are certain difficulties with known icemakers. In particular, known icemakers have complex designs with a multiplicity of parts, particularly in the switching elements, increasing cost and reducing reliability. Furthermore, known icemakers require the use of stallable motors which are more expensive than non-stallable motors. Also, to perform an installation test of an existing icemaker, an installer must manually advance the switch timing mechanisms, which can require uncomfortable and difficult manipulation and increases the likelihood of damage to the icemaker during installation.

Thus, it is an object of the invention to provide a simplified icemaker with fewer parts and greater reliability, particularly in the switching mechanisms.

Further, it is an object of the invention to provide an icemaker in which the need for a stallable timing motor is eliminated.

Further, it is an object of the invention to provide an icemaker having an improved installation testing procedure.

SUMMARY OF THE INVENTION

In accordance with one aspect of the invention, there is provided an icemaker timer having a dual-activated switch which combines the motion of two cams to operate a single switch. Specifically, this switch is used as a combination motor/feeler switch to halt ice production when the storage bin is full.

In another aspect, the invention features an icemaker timer having a switch which is closed by rotating a connector between two contacts. By moving one of the contacts, the duration of switch closure may be conveniently varied, for example to provide a water valve control.

In another aspect, the invention features a switch having two blades mounted such that, when closed, the blades make a wiping contact tending to clean the contact area and enhance reliability.

In another aspect, the invention features an icemaker timer including a manual start button for starting the motor regardless of whether the thermostat indicates that there is ice in the mold, simplifying installation of the icemaker.

In another aspect, the invention features an icemaker having a clutch mounted between the motor and ejector bar to permit slip therebetween so as to avoid stalling of the motor as the ejector bar presses upon ice in the mold, obviating the need for a more expensive stallable motor.

In another aspect, the invention features an anti-back mechanism in the icemaker drive train to prevent an installer attempting to manually cycle the icemaker from unintentionally damaging the icemaker by rotating it backwards. The mechanism is a ring placed around a pinion which drives the ejector bar via a cam wheel. The ring meshes into the teeth of the cam wheel and pinion if the cam wheel is driven backward.

In an alternative embodiment, the invention includes an icemaker having a combination deflector which not only deflects ice removed by the ejector from the ice mold, but also supports and lifts a feeler bar to determine whether the ice storage bin is full.

The above and other objects, aspects, and advantages of the present invention shall be apparent from the accompanying drawings and description thereof.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
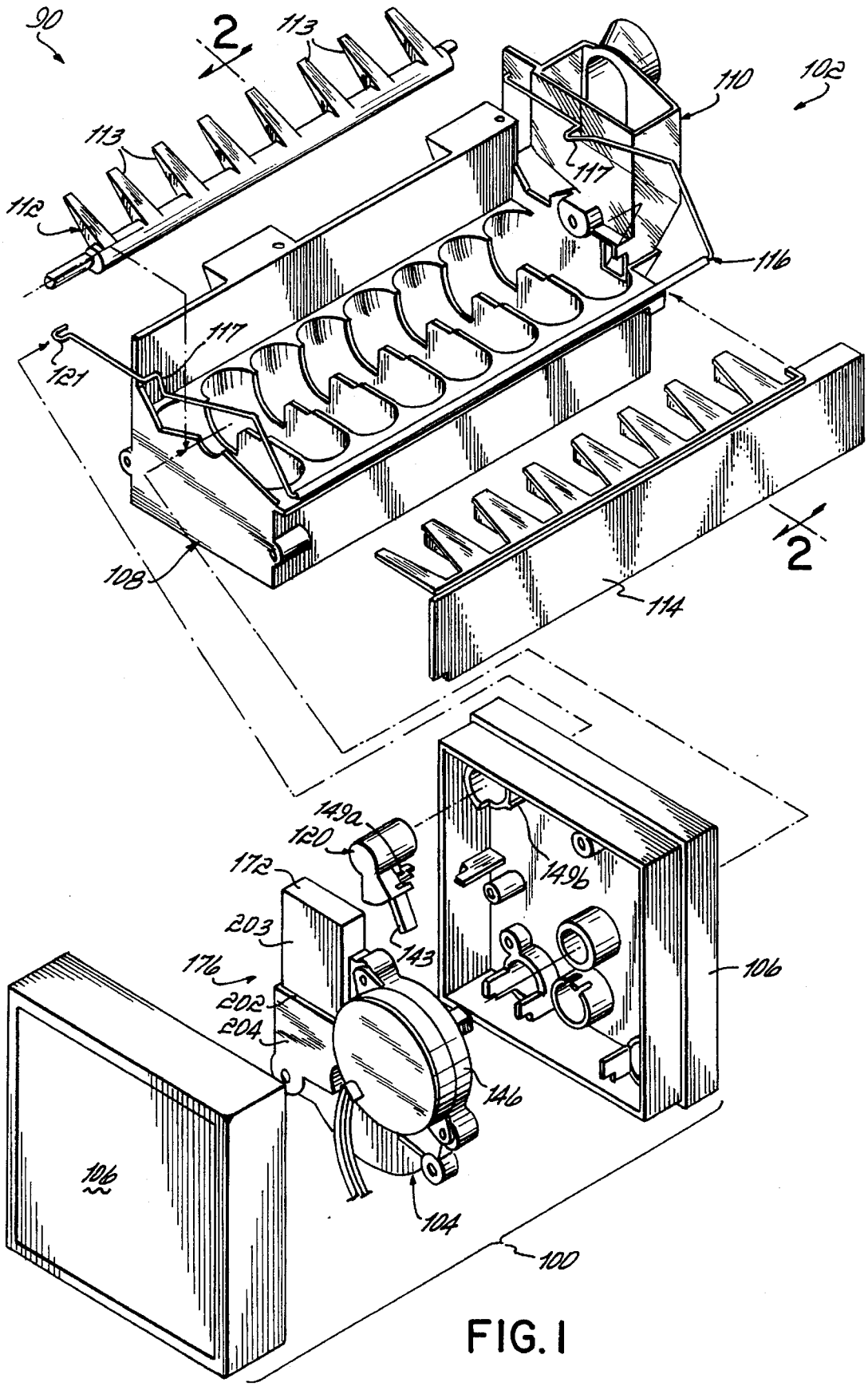
FIG. 1 is a partially exploded perspective view of an icemaker in accordance with principles of the present invention, in which certain detailed elements shown in the following FIGS. have been omitted for clarity.

Referring to FIG. 1, an icemaker 90 in accordance with principles of the present invention includes a motor and timing assembly 100 and a mold assembly 102. The motor assembly 100 includes a timing unit 104 inside of a two-piece housing 106; timing unit 104 controls the timing of the icemaker and also rotates an ejector bar 112 to eject ice from the mold assembly 102. The mold assembly 102 includes a mold body 108 having an integral electric heater (not shown) on its underside. Water enters the mold 108 through a fill valve assembly 110 and forms ice. The ice is then pushed out of the mold by the fingers 113 of the ejector bar 112.

Figure 6:
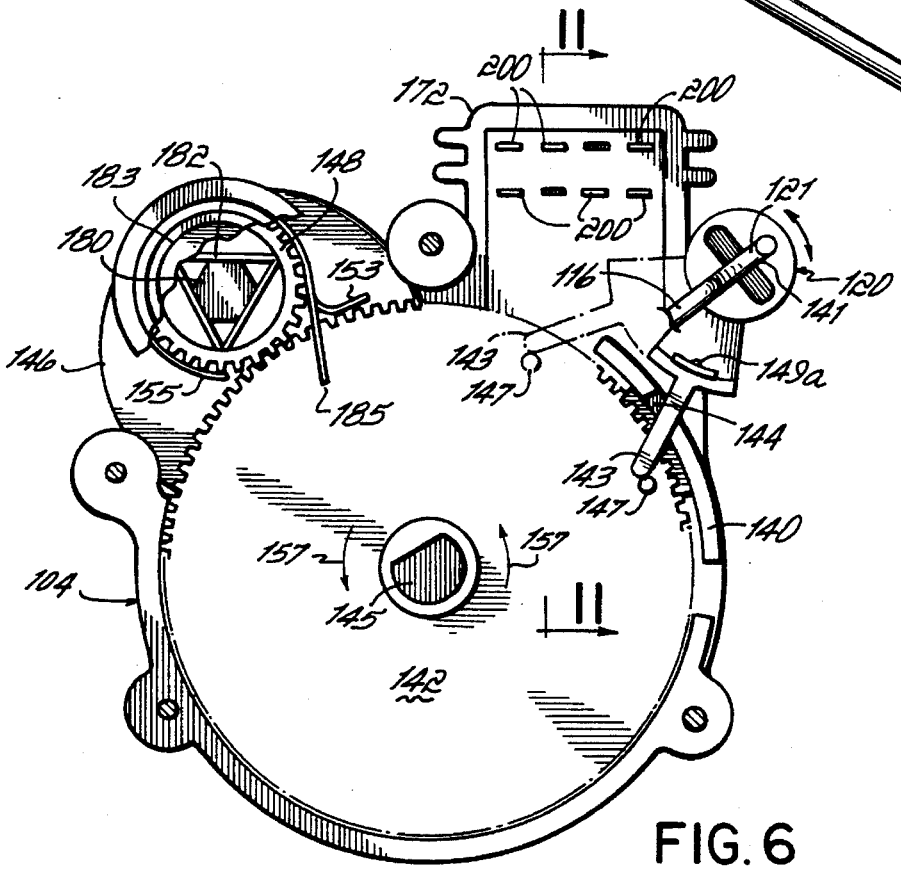
FIG. 6 is a partial cross-sectional view illustrating the timing cam and an alternative mechanism for lifting the feeler bar.

It should be noted that timing unit 104 is fairly self-contained; that is, its has only a few mechanical or electrical connections to the remainder of the icemaker. The mechanical connections are limited to a few mounting screws (not shown) and the coupling to the ejector bar 112 (see FIG. 6, element 145), and are easily disconnectable. The electrical connections, which include a single ground connection leading from the motor and a set of connections 200 shown in FIG. 6, are similarly easily disconnectable. Thus, timing unit 104 can be quickly disconnected and removed for replacement, facilitating servicing of the icemaker.

Figure 2A:
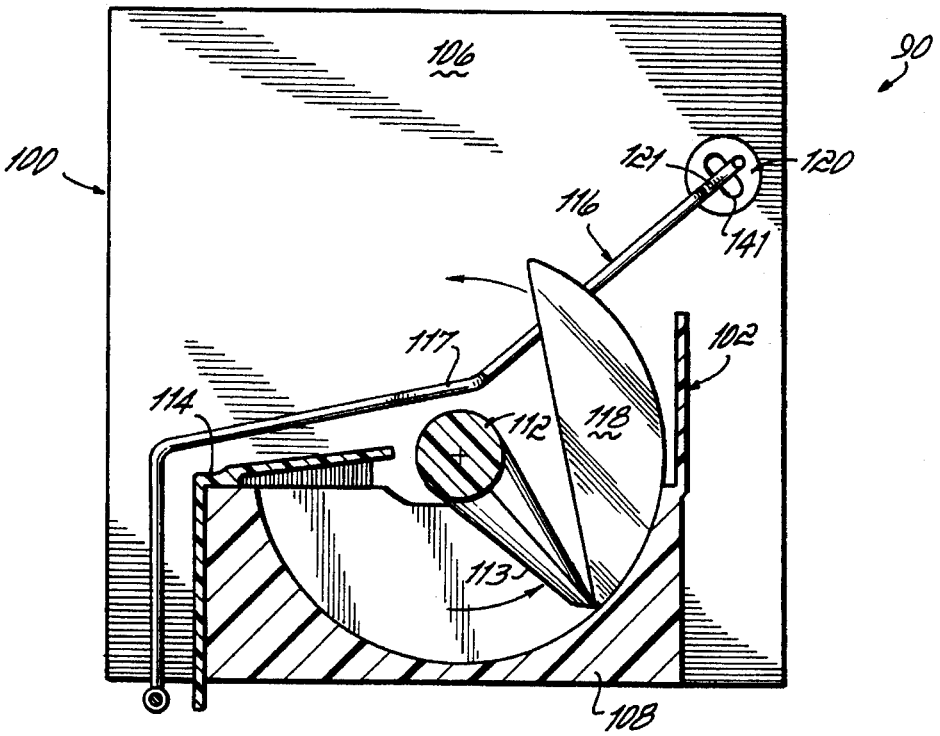
FIGS. 2A and 2B are cross-sectional views of the mold tray of FIG. 1 taken along lines 2—2 of FIG. 1, showing the fingers of the ejector bar removing ice from the mold and lifting the feeler bar.
Figure 2B:
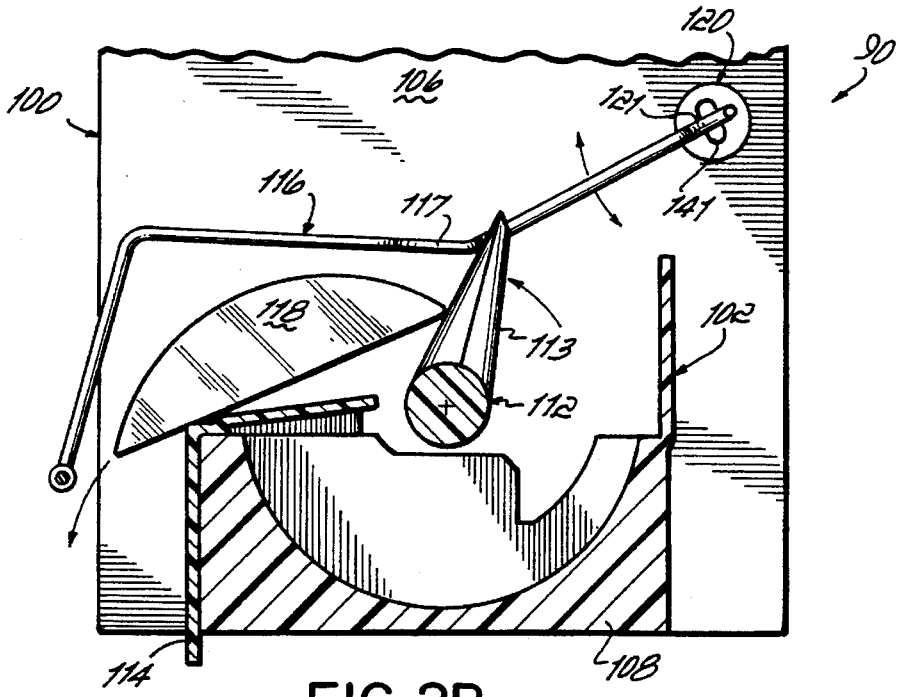

As shown in FIGS. 2A and 2B, counterclockwise rotation of the ejector bar 112 causes fingers 113 to push cubes 118 of ice out of the mold body 108. When the cubes 118 emerge from the mold 108, they slide along the upper surface of deflector 114, and fall into a holding bin below the icemaker (not shown) where they are stored until needed.

The mold assembly 102 also includes a feeler bar 116. After ice is ejected from the mold body, feeler bar 116 is lifted upwards and released onto the top of the ice in the holding bin. As shown in FIG. 1, the feeler bar 116 includes a small loop 117 which is engaged by the outermost of the ejector bar fingers 113 as they rotate through the mold body 108. This causes the feeler bar 116 to move upwards, as shown in FIG. 2B. (In an alternative embodiment, cams molded into ejector bar 112 may engage loop 117 and lift feeler bar 116 rather than the outermost of fingers 113.) If, after being thus lifted, feeler bar 116 returns to a position near to its original position, indicating that the holding bin is not full, the icemaker 90 performs another harvest cycle. If, on the other hand, the feeler bar 116 does not return to its original position, indicating that the holding bin is full, the icemaker 90 halts operation and waits for the feeler bar 116 to return to its original position (e.g., when enough ice in the holding bin is used, or sublimates).

The functions of the preceding paragraph are accomplished by a feeler switch (blades 192 and 198) in the timing unit 104, discussed in detail below. This switch is actuated by motion of a feeler bar cap 120 which fits snugly over the end 121 of the feeler bar 116. As shown in FIGS. 1, 2A and 2B, when the feeler bar 116 is raised and lowered by engagement of the ejector bar fingers 113, the feeler bar 116 rotates feeler bar cap 120. This actuates the feeler switch inside of timing unit 104, in a manner described below.

Combination Deflector/Feeler Arm

Figure 3:
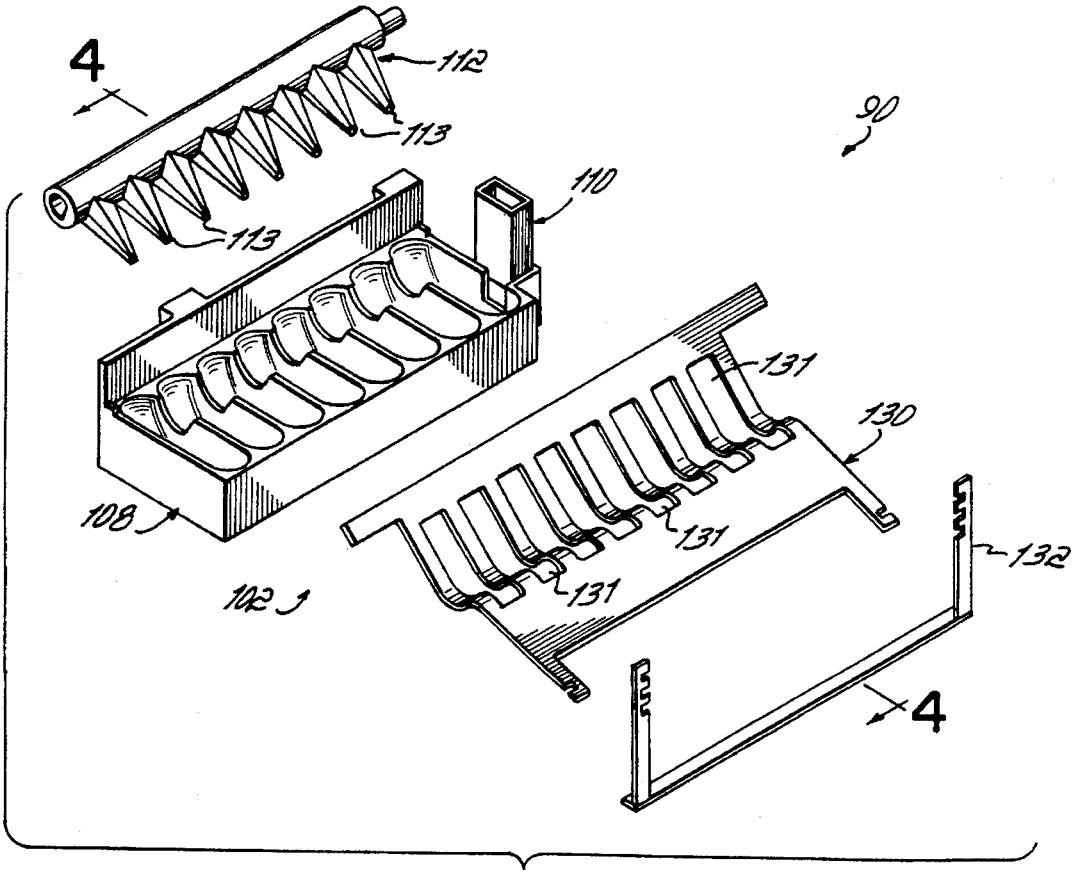
FIG. 3 is a partially exploded perspective view of an alternative embodiment of an icemaker mold tray in accordance with principles of the present invention.

Referring to FIG. 3, in an alternative embodiment of the mold assembly 108, the feeler bar and deflector bar are integrated into a single unit 130, 132. In this embodiment, the ejector bar fingers 113 rotate in the opposite direction of that in FIG. 1.

Figure 4A:
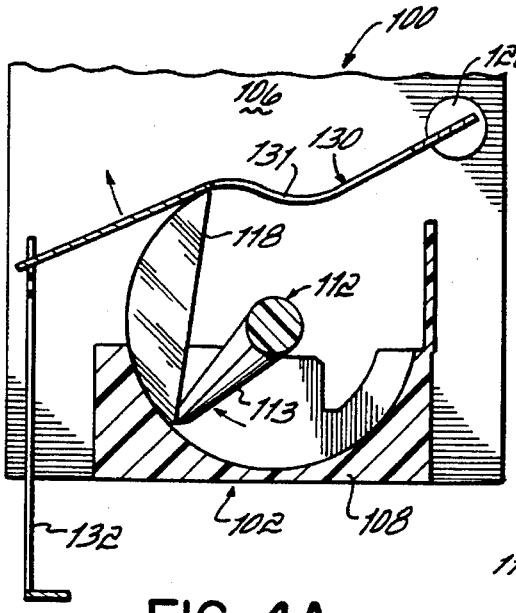
FIGS. 4A and 4B are cross-sectional views of the mold tray of FIG. 3 taken along lines 4—4, showing the fingers of the ejector bar removing ice from the mold and lifting the feeler bar.
Figure 4B:
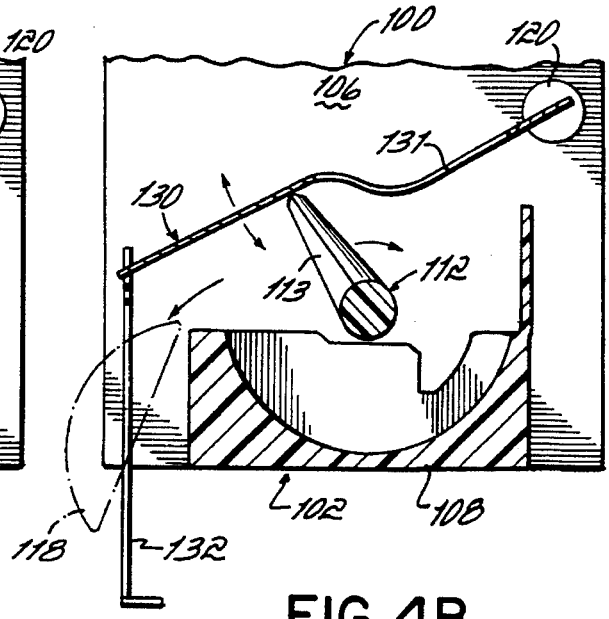

As illustrated in FIGS. 4A and 4B, in this alternative embodiment, the ejector bar 112 rotates clockwise through the mold body 108 to push ice cubes 118 out of the mold. As seen in FIG. 4A, during this operation, section 130 of the combined feeler/deflector forces the ice to eject downwards out of the mold body and into the holding bin below. Thereafter, as seen in FIG. 4B, the ejector bar fingers 113 engage section 130 of the combined feeler/deflector and force it upwards, lifting section 132 upwards out of the holding bin.

Some time thereafter, as the ejector bar fingers 113 continue to rotate, the fingers mesh through windows 131 (FIG. 3) in section 130 of the combined feeler/deflector, allowing the feeler/deflector to lower back down. As with the embodiment shown in FIG. 1, the motion of section 130 of the combined feeler/deflector is coupled to feeler bar cap 120, and used within the timing unit 104 to determine whether to perform another ice harvest cycle. If section 132 of the feeler/deflector comes to rest on ice within the storage bin, the feeler/deflector and feeler bar cap 120 will not return close to their original positions, and timing unit 104 will not initiate another harvest cycle; however, if the feeler/deflector and feeler bar cap 120 do return to their original positions, another harvest cycles will be initiated.

Figure 5:
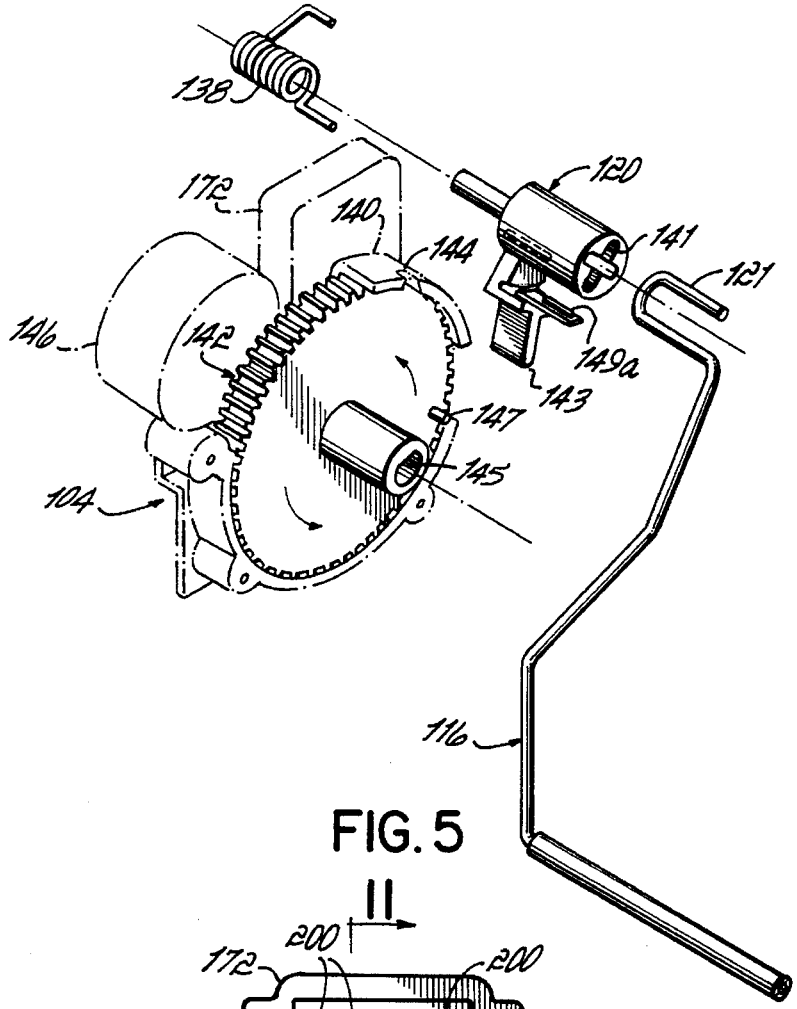
FIG. 5 is a partially exploded perspective view taken from the reverse angle from FIG. 1, showing the feeler bar mechanism.

FIG. 5, which is a perspective view taken from a reverse angle from FIGS. 1 and 3, illustrates in greater detail the connection between the feeler bar 116, feeler bar cap 120 and timing unit 104 for the icemaker 90 shown in FIG. 1. End 121 of feeler bar 116 inserts into a mating aperture 141 in feeler bar cap 120, causing feeler bar cap 120 to rotate with motion of feeler bar 116.

Referring to FIGS. 5 and 6, the end of ejector bar 112 (FIG. 1) inserts into aperture 145 in cam wheel 142. Cam wheel 142 thereby delivers rotational torque from motor 146 to ejector bar 112. Motor 146 is a non-stall AC motor which operates at approximately one revolution per minute. Motor 146 drives a pinion gear 148 which engages cam wheel 142. The tooth ratio between pinion gear 148 and cam wheel 142 is 3:1, therefore, when motor 146 is running cam wheel 142 rotates at an angular velocity of 1 rotation every three minutes.

Figure 7:
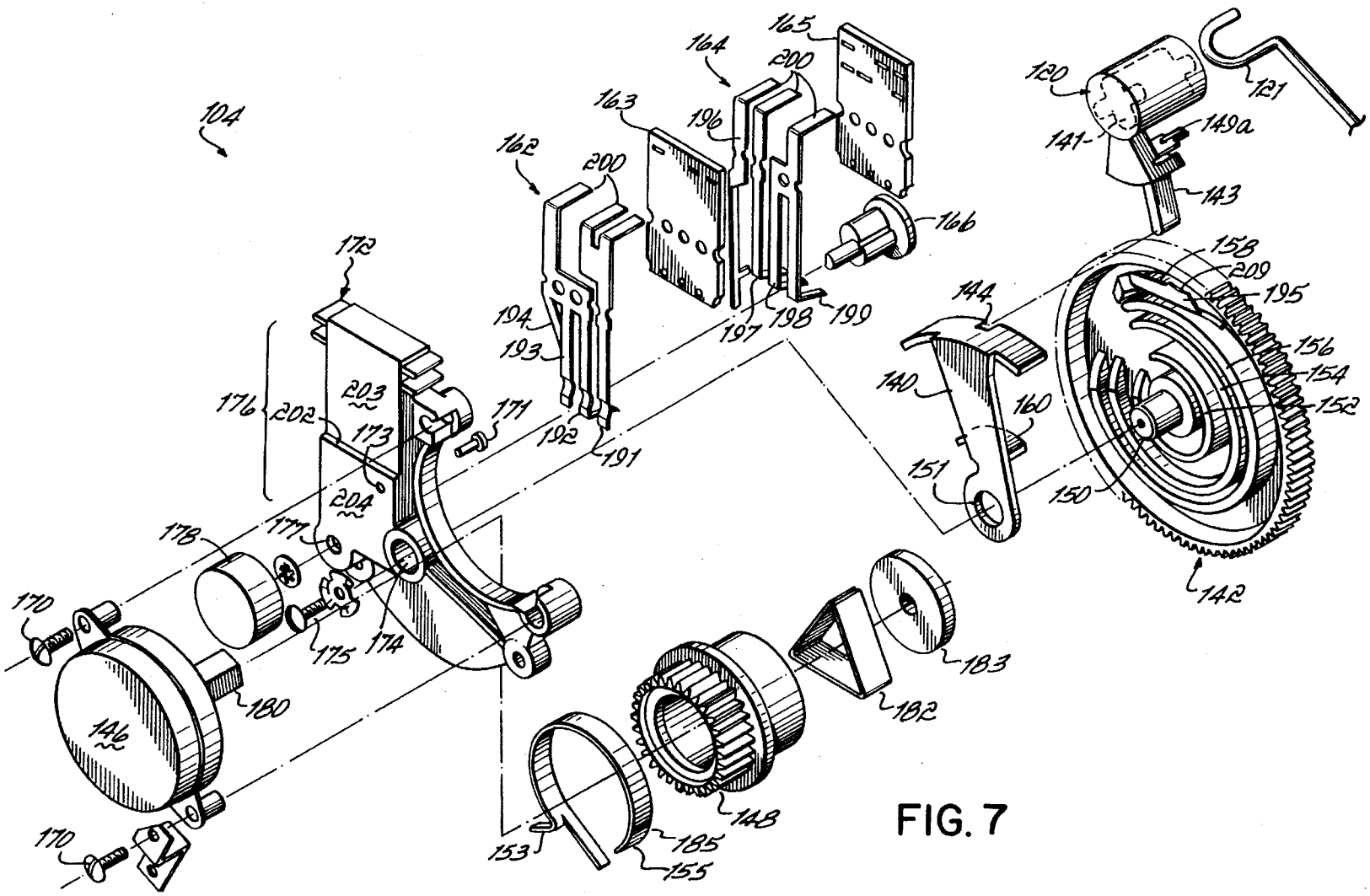
FIG. 7 is an exploded perspective view of the timing cam assembly.

Also shown in FIGS. 5 and 6 is feeler bar cam slider 140 (which can be seen in full in FIG. 7). This slider rotates about the same axis as cam wheel 142. Finger 143 on feeler bar cap 120 engages into a slot 144 of a feeler bar cam slider 140, so that rotation of feeler bar cap 120 (in response to movement of feeler bar 116) is translated into rotation of feeler bar cam slider 140. Two positions of feeler bar cap 120 are shown in FIG. 6, illustrating the rotational movement imparted to feeler bar cam slider 140 in response to raising and lowering of feeler bar 116.

As noted in further detail below, raising and lowering feeler bar 116 changes the electrical behavior of the icemaker, so that no ice is made whenever sufficient ice is in the storage bin, i.e., whenever feeler bar 116 does not return to its down position after being lifted as described above. This feature may be further employed to provide a storage mode for the icemaker. To do so, cap 120 may be molded with a catch 149*a* in the form of a detent which mates with a similar detent 149*b* in housing 106 (FIG. 1).

FIGS. 5 and 6 also illustrate a third embodiment for raising and lowering feeler bar 116. In this embodiment, there is no bend 117 in feeler bar 116 such as is shown in FIG. 1. Instead, cam wheel 142 includes a small pin 147 which, by rotation of cam wheel 142, engages finger 143 of feeler bar cap 120 and thereby causes feeler bar cap 120 to rotate and raise feeler bar 116. After pin 147 has rotated past finger 143, feeler bar 116 is allowed to lower back into the holding bin and thereby sense the ice level in the bin.

As shown in FIG. 5, if necessary to ensure that feeler bar 116 lowers properly, a spring 138 can be attached to feeler bar cap 120 to provide positive torque to feeler bar cap 120 tending to push feeler bar 116 back into the holding bin.

Finally, FIG. 6 illustrates the connectors 200 (shown in more detail below) which electrically connect the switches inside of the timing unit to the remainder of the icemaker. As noted above, because these connectors are grouped together, the timing unit can be easily connected and disconnected from the remainder of the icemaker, simplifying maintenance.

FIG. 7 is an exploded perspective view of the timing unit 104, taken from a reverse angle from FIG. 5, showing further details of the internal operation of the unit. Slider 140 includes a central hole 151 which rests on the hub 150 of cam wheel 142 and therefore slider 140 rotates on the same axis as cam wheel 142.

The internal face of cam wheel 142 includes four actuating cams risers 152, 154, 156, 158 which rotate with motion of the motor 146 and ejector bar 112. Furthermore, slider 140 includes a fifth cam 160 which, when assembled to the cam wheel 142, fits between cam risers 152 and 154, and rotates therein with motion of the feeler bar. As discussed in more detail below, these five cams, and a fill timing cam 166, interact with four front switch blades 164 and four rear switch blades 162 to create desired electrical switching patterns operating the motor, heater, and water fill valve.

Assembly of the timing unit 104 proceeds as follows: motor 146 is mounted with two mounting screws 170 to the main housing 172 of the timing unit 104. Then, manual start switch 171 is inserted into aperture 173 in area 176 of main housing 172, so that the end of switch 171 protrudes outside of housing 172. Thereafter, switch blades 162 and 164 are inserted into mounting area 176 in housing 172, and are held in position by two insulating plates 163 and 165.

After the switch blades and insulating plates are mounted, fill timing cam 166 is mounted by inserting its narrow end through aperture 177 and snapping knob 178 onto the end. Once this is completed, cam wheel 142 is mounted to housing 172 by inserting its hub 150 (carrying slider 140) through aperture 174 and fitting screw 175.

Clutch

The motor drive train is then assembled and connected to the motor 146 and cam wheel 142. Drive pinion 148 has a hollow center which accepts a triangular slip clutch 182, which is held in place by a cover 183. After the slip clutch 182 has been mounted in drive pinion 148, anti-back ring 185 is placed around the outer gears of drive pinion 148, and pinion 148 is placed over the drive shaft 180 of motor 146 and into engagement with the gears on the outer rim of cam wheel 142.

As shown in FIG. 7, drive shaft 180 has a hexagonal shape. This hexagonal drive shaft engages the walls of the triangular slip clutch 182, providing a resilient spring-clutch engagement between drive shaft 180 and pinion 148. FIG. 6 includes an end view of the completed assembly, showing hexagonal drive shaft 180 inside of triangular slip clutch 182, which is itself inside the hollow center of pinion 148 and held in place by cover 183.

Triangular slip clutch 182 is manufactured of a resilient spring metal. Under normal operating torque loads, the walls of triangular slip clutch will not bend significantly, and pinion 148 will rotate with drive shaft 180. However, under high torque loads (under operating conditions noted below), the walls of triangular slip clutch 182 will resiliently bend outward under rotational pressure from drive shaft 180, allowing drive shaft 180 to rotate relative to pinion 148, i.e., allowing motor 146 to continue rotating without rotating cam wheel 142. As noted further below, by including this unique, inexpensive clutch into the motor drive train, the icemaker need not use a stallable motor; instead, the icemaker can use a less expensive non-stallable timing motor.

Figure 8A:
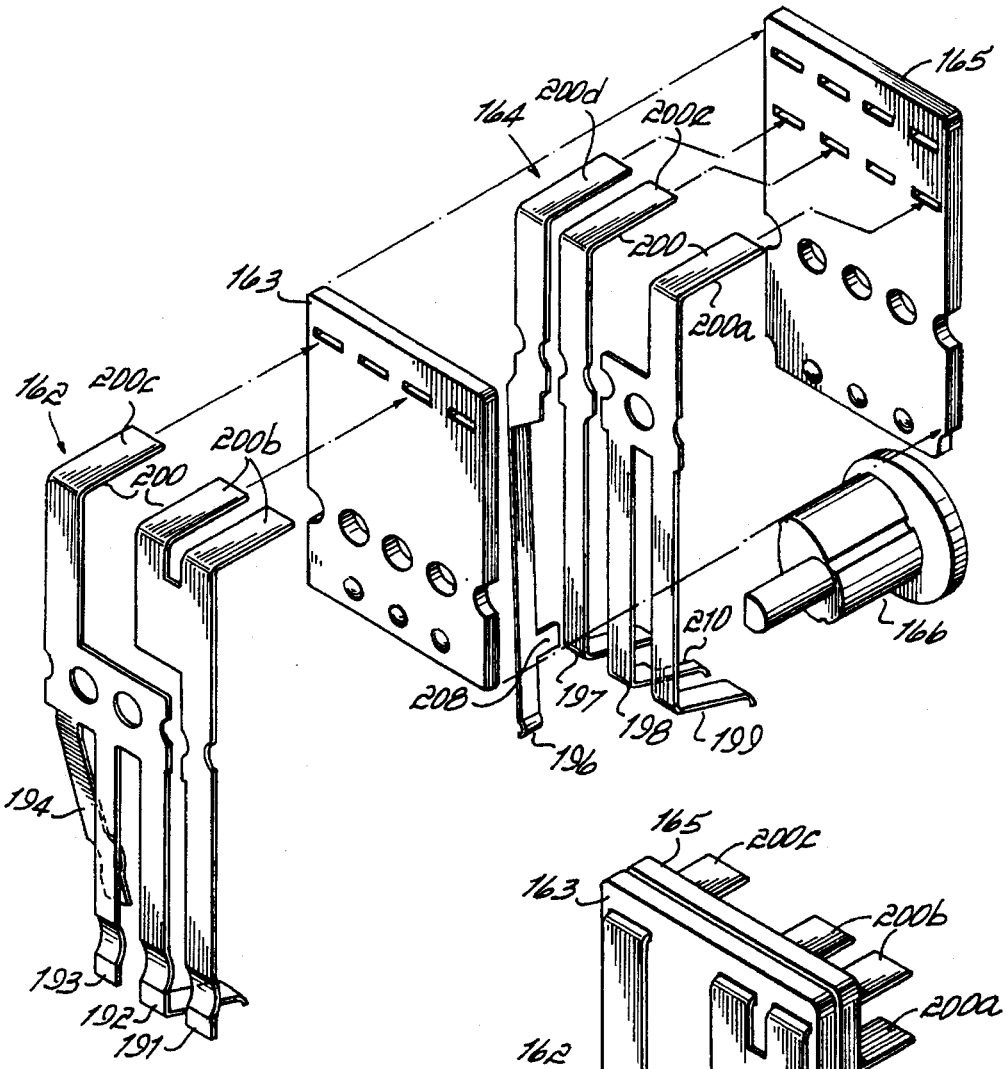
FIG. 8A an exploded perspective view of the four cam switches and the water fill adjustment cam.
Figure 8B:
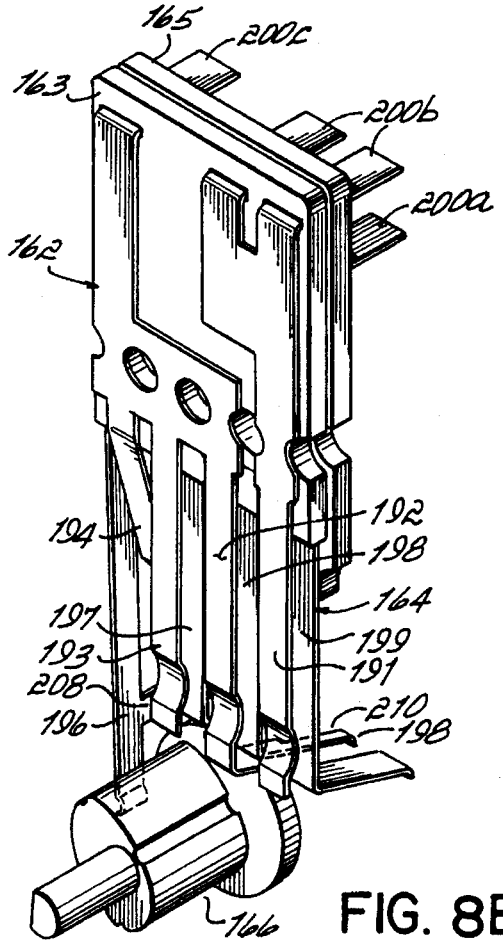
FIG. 8B is an assembled perspective view of the switches and water fill adjustment cam.

FIGS. 8A and 8B are detailed views of the switch blades 162, 164 and insulating plates 163, 165 of FIG. 7, showing the assembly of the switch blades into switches. Switch blades 162 include four individual blades 191, 192, 193 and 194, and blades 164 include four individual blades 196, 197, 198 and 199. As seen in FIG. 8B, when switch blades 162 and 164 are assembled with insulating plates 163, 165, pairs of the individual blades 191 and 199, 192 and 198, 193 and 197, and 194 and 196 respectively form four pairs of electrical switch contacts. These switches form electrical connections to control functions of the icemaker 90. The heater, valve, thermostat, and motor, and electrical power, are coupled to the connectors 200 on the upper ends of blades 162 and 164, and are thereby electrically controlled by the four electrical switches. (Details of the circuits created by the four switches are provided in FIGS. 12A–12C.)

FIG. 8B also illustrates the interaction between cam 166 and the switch blades. As shown in greater detail below, blade 196 engages the surface of cam 166 and is bent thereby inward and outward as cam 166 is rotated by movement of knob 178 (shown in FIG. 7).

Figure 9A:
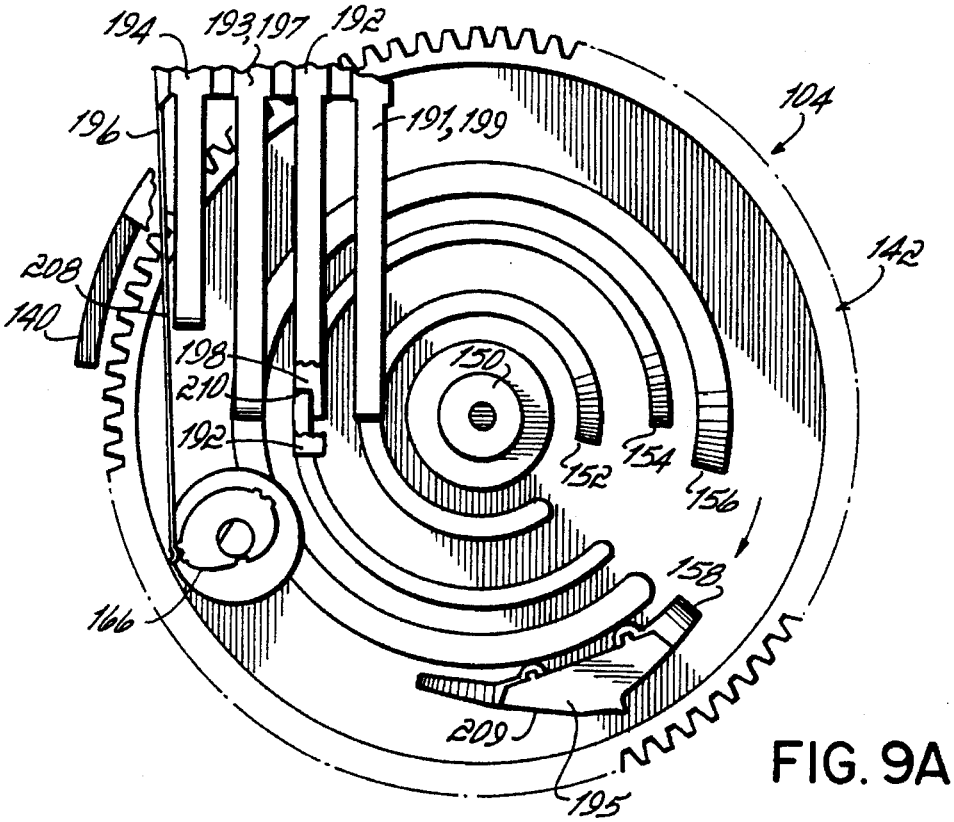
FIGS. 9A and 9B are cross-sectional views of the timing cam assembly showing the switch cam and switches for two different positions of the water fill adjustment cam.
Figure 9B:
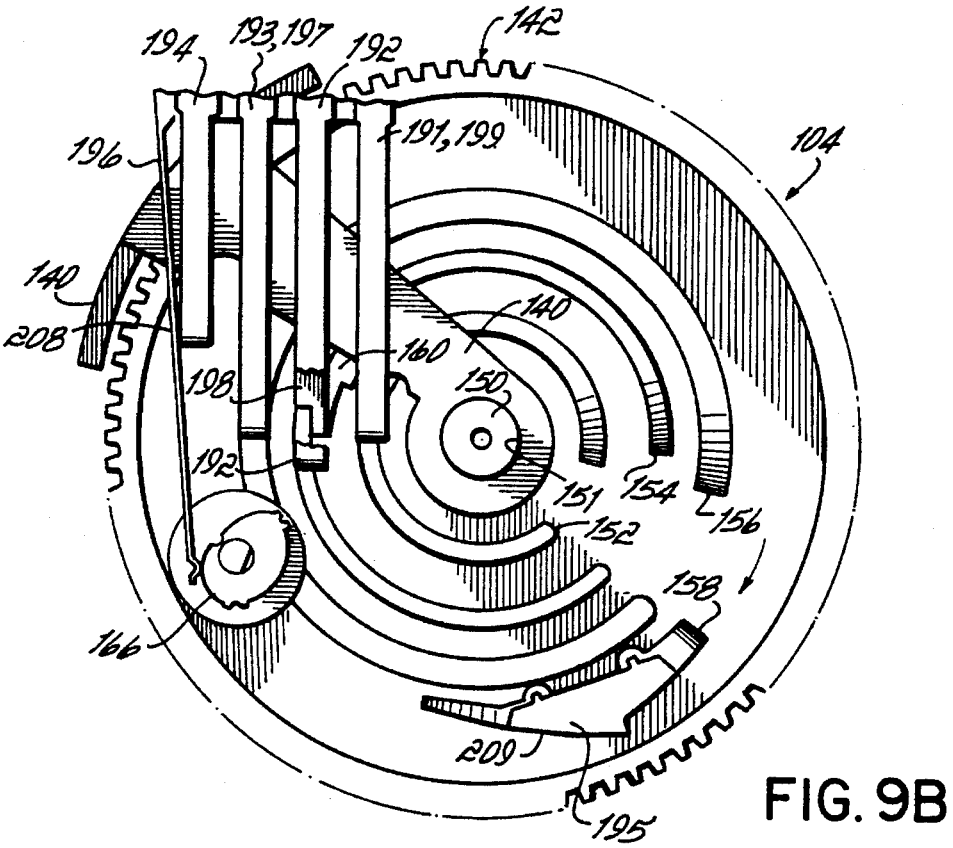

FIGS. 9A and 9B show the assembled switch blades 162, 164 and cam 166 assembled to cam wheel 142. As illustrated, each of the four rotating cam risers 152, 154, 156, 158 respectively engages and manipulates one of the switch blade pairs 194/196, 193/197, 192/198 and 191/199. Thus, as cam wheel 142 rotates, it sequentially opens and closes individual switches to achieve the desired electro-mechanical operation of the icemaker.

Blade pairs 193/197 and 191/199 form, respectively, the "heater" and "hold" switches, and operate as follows. The associated cam risers 156 and 152 engage the switch blades 197 and 199 which face the cam risers, and press these switch blades away from cam wheel 142 and into the associated switch blades 193 and 191, making electrical contact. When the cam risers 156 and 152 are not thus engaging the switch blades, the switch blades do not contact each other. Thus, the second and fourth switches are open whenever the associated cam risers 152 and 156 are not engaging blades 197 and 199; otherwise, the switches are closed.

Water Valve Switch

Blade pair 194 and 196 forms the "water valve" switch, which works differently from the heater and hold switches. In the water valve switch, blades 194 and 196 never contact each other; rather, the cam riser includes a moving connector 195 which engages blades 194 and 196 at the same time, creating an electrical connection therebetween. Blade 194 engages the top surface of the connector 195 shown in FIG. 9A. Blade 196 includes a tab 208 (FIGS. 8A–8B) which engages the side 209 (FIGS. 9A–9B) of connector 195, forming an electrical connection.

Side 209 of connector 195 has a radially sloping surface. This surface is used in conjunction with tab 208 and cam 166 to adjust the duration of the contact between blades 194 and 196, and thereby adjust the length of time that the water valve is opened. As is apparent from FIG. 9A, cam 166 can be rotated to bend blade 196, and therefore tab 208, radially inward and outward with respect to cam wheel 142. In FIG. 9A, cam 166 has been rotated to its position of greatest radial deflection; in this position tab 208 contacts the outer surface 209 of connector 195 for a brief angular distance where connector 195 extends radially outward to its furthest extent. However, in FIG. 9B, cam 166 has been rotated to a position of lesser radial deflection; in this position tab 208 contacts the outer surface 209 of connector 195 for a greater angular distance, nearly throughout the angular length of connector 195.

Thus, by cooperation of connector 195 and blades 194 and 196, rotation of cam 166 adjusts the duration of the closure of the water fill switch, and thereby (as illustrated in greater detail below) provides a cube size adjustment.

Figure 10:
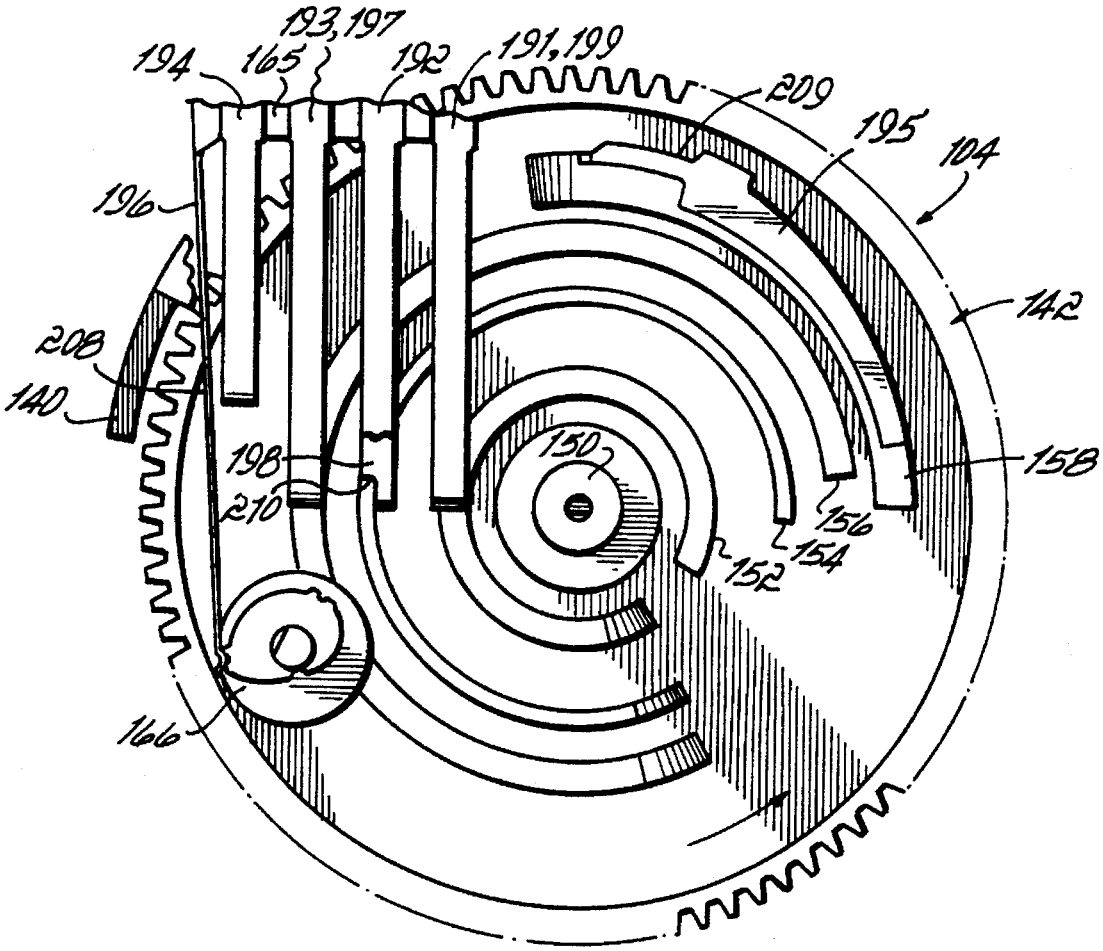
FIG. 10 is a cross-section view of an alternative embodiment of a timing cam assembly for use with the embodiment of the mold tray shown in FIGS. 3, 4A and 4B.

FIG. 10 illustrates an alternative embodiment of cam wheel 142 for use in the embodiment of FIGS. 3, 4A and 4B in which the ejector bar rotates in a reversed direction. In the embodiment of FIG. 10, the cam risers 152–158 rotate in an opposite direction to that shown in FIGS. 9A–9B, and contact 195 has a differing profile. (The embodiment of FIG. 10 is used with a motor having a greater rotational speed than 1 RPM, thus contact 195 has a greater angular length.) Other than these modifications, the operation of the switches is substantially similar to the embodiment of FIGS. 9A and 9B.

Bi-actuated Feeler Bar Switch

Referring again to FIGS. 9A and 9B, blade pair 192 and 198 forms the "feeler bar" switch, which operates in a yet different manner.

In the feeler bar switch, the associated cam riser 154 engages the switch blade 192, i.e., the rearward switch blade, rather than (as in the motor and hold switches) the front switch blade 198. As illustrated, cam riser 154 has a half-width, and front switch blade 198 has a cutaway section 210 which extends around cam riser 154 such that the front blade 198 is not engaged by cam riser 154. Thus, rather than engaging the front blade 198, cam riser 154 engages the rearward blade 192, and thereby moves blade 192 away from blade 198.

The front blade 198 is actuated by slider 140 (shown in FIG. 9B). As noted above, slider 140 is rotated by feeler bar cap 120 in response to raising and lowering of the feeler bar 116 (FIG. 5). This rotation causes slider 140 to engage and deflect front blade 198 toward and away from rearward blade 192.

Figure 11:
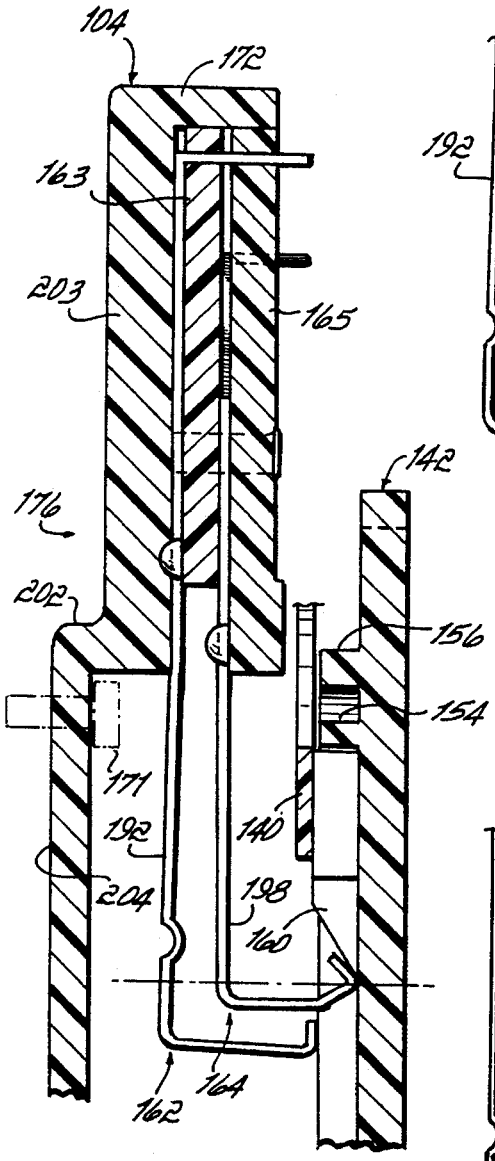
FIGS. 11, 11A, 11B, 11C and 11D are cross-sectional views taken along lines 11—11 of FIG. 6, of the timing cam assembly showing the operation of the feeler bar mechanism upon the third hi-actuated switch.
Figure 11A:
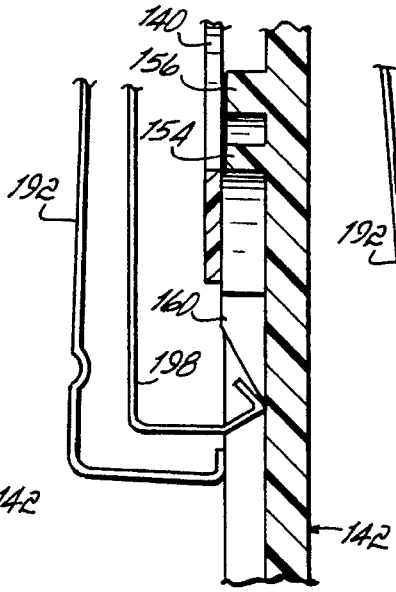
Figure 11B:
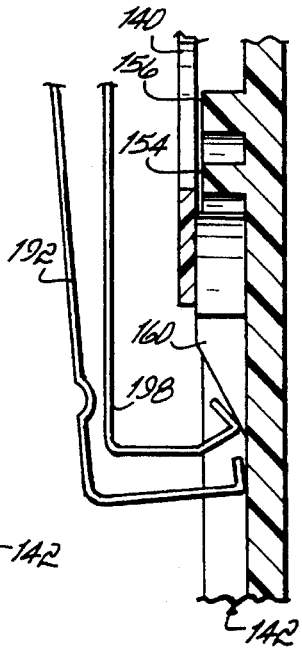
Figure 11C:
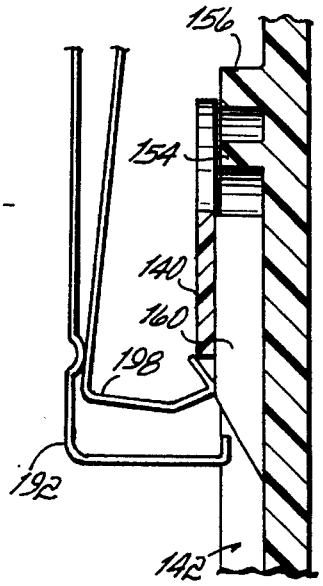
Figure 11D:
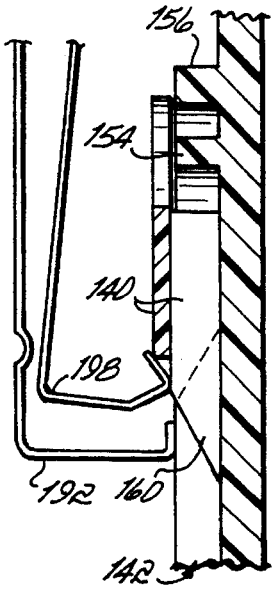

FIGS. 11–11D illustrate the operation of the feeler bar switch in greater detail. FIG. 11 is a full cross-sectional view of the switch blades showing generally the alignment of switch blades 162, 164 and the cam risers of cam wheel 142. FIGS. 11A–11D are partial cross-sectional views specifically illustrating the four orientations of blades 198 and 192 in response to engagement, or lack thereof, of slider 140 and cam riser 154. FIGS. 11A and 11B show the motion of the blades when feeler bar 116 is up (see FIG. 2B), indicating that there is sufficient ice in the storage bin (or that the icemaker has been locked off). In this state, rearward blade 192 will not contact front blade 198, regardless of whether cam riser 154 is actuating (FIG. 11A) or not actuating (FIG. 11B) rearward blade 192. However, as shown in FIGS. 11C and 11D, such is not the case when feeler bar 116 is down (see FIG. 2A), indicating that there is not sufficient ice in the storage bin. In this situation, blade 198 will contact blade 192 whenever cam riser 154 is not actuating rearward blade 192 (FIG. 11C). However, when cam riser 154 is actuating rearward blade 192 (FIG. 11D), blade 198 will not contact blade 192.

Thus, to summarize, when the feeler bar is up, the feeler switch will be open regardless of the position of the cam wheel 142. However, when the feeler bar is down, the feeler switch will be open when cam riser 154 is actuating rearward blade 192; otherwise, the feeler switch will be closed.

Self-Cleaning Switch Mounting

FIG. 11 illustrates mounting area 176 of housing 172 shown in FIG. 7, into which the assembled switches are attached. As shown, each of the switch blades 162 are mounted flush to an upper section 203 of mounting area 176. A small projecting rim 202 in mounting area 176 separates upper section 203 from a lower section 204 which is spaced away from switch blades 162. Thus, the portion of switch blades 162 above rim 202 are held firmly against housing 172 and cannot bend; however, the portions of switch blades 162 projecting below rim 202 do not contact housing 172 and can bend inward into the housing for a distance before contacting lower section 204 of the housing.

As a result of this arrangement, when one of the switch blades 164 is pushed into the mating one of the switch blades 162, closing the corresponding switch, both switch blades will bend under the contact pressure; however, the blades will not bend from the same pivot points. Switch blades 164 bend around the bottom edge of insulating plate 163, whereas switch blades 162 bend around rim 202. Because the blades bend at differing pivot points, as the blades are pressed into each other there is a wiping action at the point of contact. This wiping action tends to clean the contact points and thereby increases reliability.

Figure 12A:
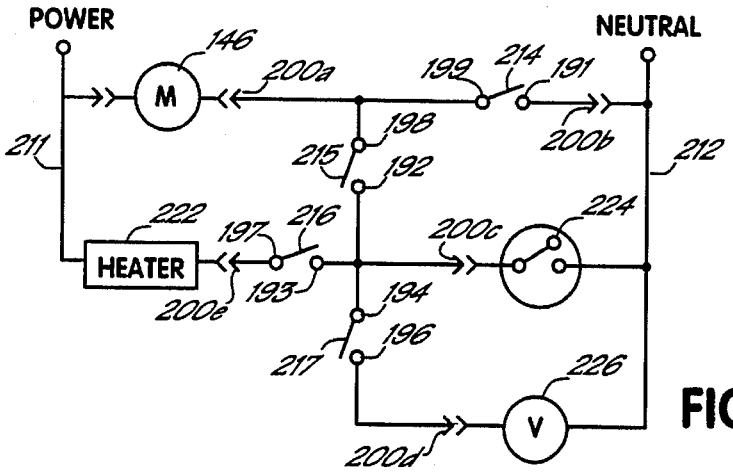
FIGS. 12A, 12B, 12C and 12D are circuit diagrams of alternative electrical circuits.

FIG. 12A illustrates an electrical circuit formed by the four switches and the other elements of the icemaker, which can be best understood by simultaneous reference to FIG. 8A which shows the corresponding switch blades and connectors. As shown in FIG. 12A, AC electrical power from the host refrigerator on line 211 is applied to one terminal of motor 146 and a heater coil 222. The second terminal of the motor is attached to connector 200*a* (FIG. 8A) which connects to switch blade 199 of hold switch 214 and switch blade 198 of feeler switch 215. (Note that blades 198 and 199 are formed of a common strip of metal, thereby creating an electrical connection therebetween.) The neutral line 212 from the refrigerator is connected to switch blade 191 of hold switch 214 by a second connector 200*b*, as is one terminal of a thermostatic switch 224 (of the type which closes when cold) and a solenoid-controlled water valve 226. The opposing terminal of thermostatic switch 224 is connected to a third connector 200*c* and thus to switch blade 192 of feeler switch 215, blade 193 of heater switch 216, and blade 194 of valve switch 217. (Here again, blades 192, 193 and 194 are formed of a common strip of metal, thereby creating an electrical connection therebetween.) The opposing terminal of heater 222 is connected to a fifth connector 200*e* leading to blade 197 of heater switch 216. Finally, the opposing terminal of valve 226 is connected to a fourth connector 200*d* leading to blade 196 of valve switch 217.

It should be noted that, in the circuit of FIG. 12A, each of the connectors 200 connects to exactly one wire leading from other components of the icemaker. Two-wire connectors are difficult to manufacture, and therefore expensive. Thus, the circuits of FIG. 12A has a cost advantage in that they it does not require two-wire connectors.

Figure 12B:
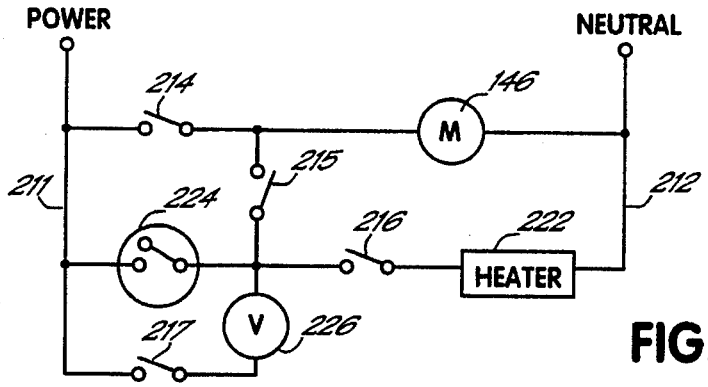

FIG. 12B illustrates an alternative circuit which, although producing the same electrical function and timing as the circuit of FIG. 12A, requires a different layout and switch blade design. Here, the neutral line 212 from the refrigerator is connected to one terminal of the motor 146 and heater 222. The opposite terminal of motor 146 is connected to a terminal of hold switch 214 and a terminal of feeler switch 215. The opposite terminal of heater 222 is connected to a terminal of heater switch 216. AC power from the refrigerator is connected to the remaining terminal of hold switch 214, a terminal of thermostat 224, and a terminal of valve switch 217. The remaining terminal of valve switch 217 is connected to a terminal of valve 226, and the opposing terminal of valve 226 is connected to the remaining terminals of thermostat 224, feeler switch 215, and heater switch 216.

The circuit of FIG. 12B would require a different layout than the circuit of FIG. 12A, requiring at least one more connector because of the isolation of valve switch 217. However, the circuit of FIG. 12B has the advantage that all of the switches connect and disconnect power from other circuit elements; in the circuit of FIG. 12A, some switches disconnect ground, rather than power, from circuit elements. As a result, a ground fault in the circuit of FIG. 12A may cause unintended current flow in circuit elements, whereas the same fault in the circuit of FIG. 12B would not cause such current flow. Foreign, and future U.S. electrical safety standards may necessitate use of a circuit such as shown in FIG. 12B.

Figure 12C:
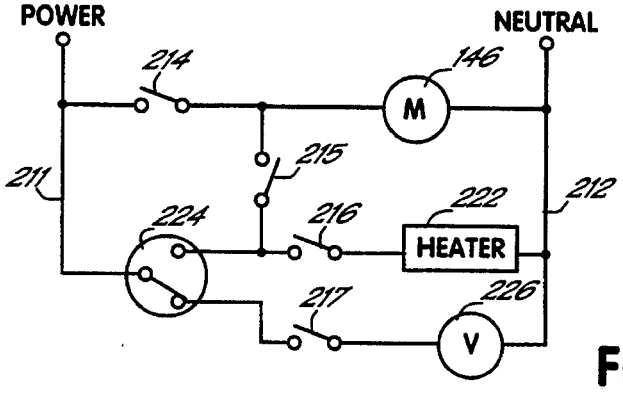

FIG. 12C illustrates an alternative circuit configured for use with a double-throw thermostatic switch 224. In this circuit, AC power from the refrigerator on line 211 connects to a terminal of hold switch 214 and the common terminal of double-throw thermostat 224. The remaining terminal of hold switch 214 connects to a terminal of motor 146 and a terminal of feeler switch 215. The remaining terminal of hold switch 214 connects to the closed-when-cold terminal of thermostat 224 and to a terminal of heater switch 216. The remaining terminal of heater switch 216 connects to heater 222. The closed-when-warm terminal of thermostat 224 connects to a terminal of valve switch 217. The remaining terminals of valve 226, heater 222 and motor 146 all connect to neutral line 212 from the refrigerator.

Figure 12D:
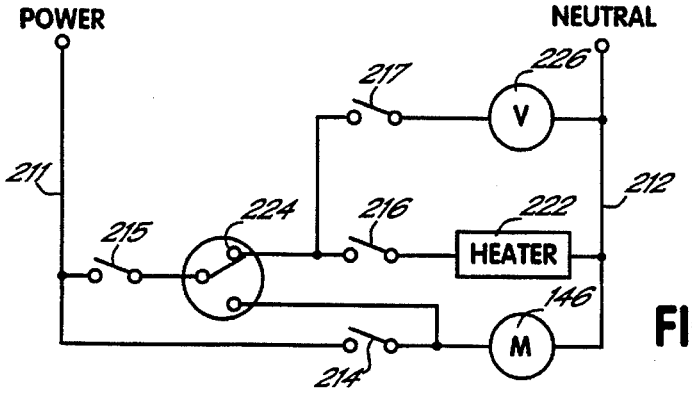

FIG. 12D shows a further alternative circuit, which achieves the same timing as the circuit of FIG. 12C. In this circuit, AC power from the refrigerator on line 211 is connected to a terminal of feeler switch 215 and to a terminal of hold switch 214. The remaining terminal of feeler switch 215 connects to the common terminal of double-throw thermostat 224. The closed-when-cold terminal of thermostat 224, and the remaining terminal of hold switch 214, connect to a terminal of motor 146. The closed-when-warm terminal of thermostat 224 connects to a terminal of valve switch 217 and heater switch 216. The remaining terminal of valve switch 217 connects to a terminal of valve 226, and the remaining terminal of heater switch 216 connects to a terminal of heater 222. The neutral line 212 from the refrigerator connects to the remaining terminals of valve 226, heater 222 and motor 146.

The double-throw thermostat circuits of FIGS. 12C and 12D provide essentially the same timing as the circuits of FIGS. 12A and 12B; the primary difference is that in the circuits of FIGS. 12A and 12B the heater operates while the valve is open and filling the mold with water, whereas in the circuits of FIGS. 12C and 12D the heater does not operate during this period.

Figure 13:
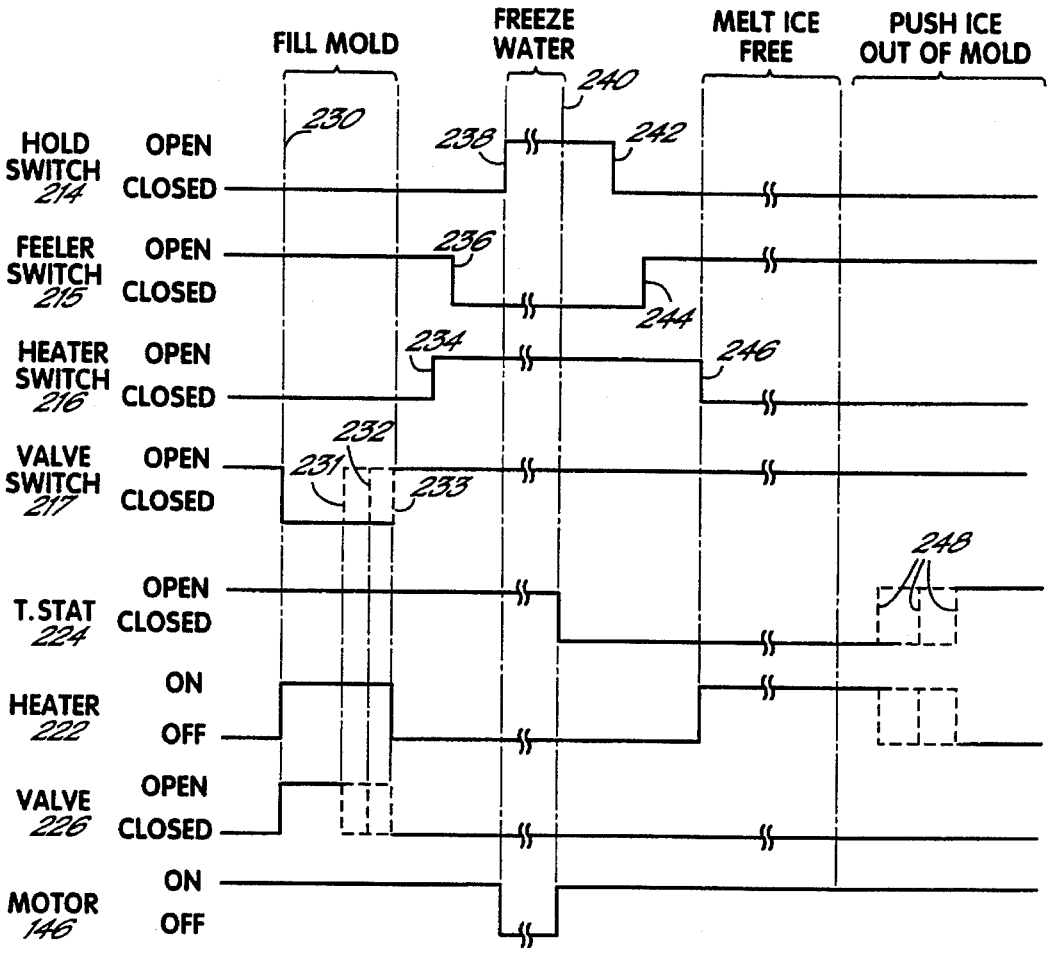
FIG. 13 is a timing diagram of a harvest cycle performed by the icemaker when using the circuit of FIG. 12A or 12B.

FIG. 13 shows the timing diagram produced by the circuit of FIG. 12A. At the beginning of a cycle, the hold and heater switches 214 and 216 are closed, and the feeler and heater switches 215 and 217 are open. Assume that at this time, the thermostat is closed, indicating that the icemaker is warm and that there is no ice in the mold.

Under the above conditions, the heater is off, the valve is closed, and the timing motor is on. Because the motor is on, cam wheel 142 slowly rotates. Eventually, at time 230, connector 195 contacts blades 194 and 196, closing the valve switch 217. This causes valve 226 to open.

Due to the wiring of the circuit of FIG. 12A, closing the valve switch 217 also causes the heater to turn on (current flowing through the valve solenoid also flows through the heater). It is unnecessary that the heater turn on at this time, however; as noted above, the circuits of FIGS. 12C and 12D above which do not create this brief heating period require the use of a double-throw thermostat, which is more expensive than a single-throw thermostat. The circuit of FIG. 12A avoids this expense by allowing the heater to operate while the valve is open. Furthermore, there is an advantage to the circuit of FIG. 12A: the valve cannot open if the heater has failed and will not draw current. Thus, if the heater fails, the mold will not fill with water and freeze, making it significantly easier to service the icemaker.

Valve 226 remains open, filling the mold with water, for a period determined by the position of water fill adjustment cam 166, as described above. Eventually, at time 231, 232, or 233, connector 195 releases contact with blades 194 and 196, opening the valve switch 217 and closing valve 226. The heater also turns off at this time.

At this point, the mold is filled with warm water, and the icemaker prepares to enter a "sleep" mode to freeze the water into ice. Thus, at time 234, cam riser 156 disengages from blade 197, causing the heater switch 216 to open. Thereafter, at time 236, cam riser 154 disengages from blade 192. Assuming for the moment that the feeler bar is down (because the ice storage bin is not full), this causes the feeler switch 215 to close (as shown in FIG. 11C above). Finally, at time 238, cam riser 152 disengages from blade 199, opening hold switch 214. Because thermostat 224 is still warm (the warm water in the mold not having had sufficient time to freeze), this last transition causes the motor to halt.

Over the following period of time, which is much longer than the other times illustrated in FIG. 13, the icemaker waits for the water in the mold to freeze. Eventually, at time 240, the water freezes into ice and reaches a sufficiently low temperature to close thermostat 224. (Thermostat 224 may, for example, be of the type that closes at approximately 15 degrees and opens at approximately 36 degrees; choosing a thermostat 224 with thresholds near to 32 degrees reduces the energy consumed heating and cooling the mold.)

Once thermostat 224 is closed (still assuming that the feeler bar 116 is down) current flows to motor 146 through thermostat 224 and feeler switch 215, and motor 146 turns on and cam 142 begins rotating. Thereafter, as cam 142 continues rotating, at time 242 cam riser 152 re-engages blade 199, closing hold switch 214 and creating a more direct path for current to flow to motor 146.

Thereafter, at time 244, cam riser 154 re-engages blade 192, opening feeler switch 215. Motor 146 continues running because current may flow to motor 146 through hold switch 214.

Next, at time 246, cam riser 156 re-engages blade 197, causing heater switch 216 to close. This turns heater 222 on and begins melting the ice away from the mold body.

As 146 motor continues running after time 246, eventually fingers 113 of ejector bar 112 engage the ice in the mold body. If the ice is not yet free from the mold body, torque builds up in the power train of the timing motor. Eventually, the walls of triangular slip clutch 182 bend to allow the hexagonal drive shaft 180 of motor 146 to continue rotating without rotating cam wheel 142 or ejector bar 112. This torquing and slipping repeats until the ice in the mold body ultimately melts free from the mold body. At this point, the cam wheel 142 and ejector bar 112 continue rotating as shown in FIGS. 2A and 2B and eject the ice from the mold body and into the storage bin below.

Although the ice has been removed from the mold body, thermostat 224 will not immediately open. Rather, it will typically take more than three minutes for thermostat 224 to open after ice has been removed from the mold body. During this period, motor 146 remains on and the icemaker performs a second full cycle.

During this second cycle, the icemaker continues through each of the switch openings and closings illustrated in FIG. 13; however, because the thermostat is closed throughout, no water enters the mold or is frozen. Thus, at time 230, when the valve switch 217 closes, the valve does not open because the valve is shorted out by the closed thermostat 224. Furthermore, at time 238, when the hold switch 214 opens, the motor does not stop running because thermostat 224 is closed and therefore current flows through thermostat 224 and feeler switch 215 to motor 146.

At some time 248, the mold body warms sufficiently (the heater having been on for most of the additional cycle described above) to open thermostat 224. Typically, when thermostat 224 opens, heater switch 216 will be closed, so that the heater 222 will be on and drawing current through thermostat 224. Thus, when thermostat 224 opens, most of the time it will open-circuit the heater current. If heater 222 has any significant inductance (which is often the case with a coil-shaped heater), this sudden open circuit will create an arc across the terminals of thermostat 224. This arc, while not harmful to thermostat 224, will help to clean the contacts of thermostat 224 and eliminates the need for corrosion-resistant terminals in the thermostat, which are expensive.

At this point, the icemaker has returned to the state depicted at the beginning of the timing diagram of FIG. 13, and the icemaker proceeds to refill the storage bin and generate a new batch of ice cubes.

The preceding discussion was drawn on the assumption that feeler bar 116 was down at the relevant times during the cycle. If, instead, feeler bar 116 was up, the operation of the icemaker would have been different as described below.

As shown in FIGS. 11A and 11B, when feeler bar 116 is up, feeler switch 215 cannot close. Thus, when feeler bar 116 is up, at time 236 feeler switch 215 does not close. If this is the case, after hold switch 214 opens at time 238, stopping motor 146, motor 146 will not re-start when thermostat 224 closes at time 240. Rather, because feeler switch 215 is open, motor 146 will remain off and the icemaker will not harvest the ice in the mold. The icemaker will only re-start when feeler bar 116 lowers, for example due to use or sublimation of ice in the storage bin, or because feeler bar 116 is lowered from a locked-up position by the owner or installer. Lowering feeler bar 116 will allow feeler switch 215 to close, turning on motor 146 and causing the icemaker to continue through a cycle and harvest the ice in the mold.

Initial testing of the icemaker raises special issues which will be appreciated from the following. When the icemaker is first installed, the installer typically tests the icemaker by waiting for it to cycle once and determining that it is creating ice cubes of the proper size and at the proper speed.

Normally there is no difficulty in following this procedure; the installer simply plugs in the refrigerator and water supply, listens for the icemaker to draw water into the mold, and waits for the cubes to form and harvest. However, a potential problem occurs if the icemaker is assembled in such a manner that the cam wheel 142 is positioned between times 233 and 242. If this occurs, a significant delay will be experienced: thermostat 224 will be open because the refrigerator has been off and is at ambient temperature. However, the mold will not fill with water because the cam wheel will initiate beyond time 233. Therefore, the icemaker will progress to time 238 and motor 146 will turn off without water in the mold. As described above, once in this state, the icemaker will not continue cycling until thermostat 224 closes. However, it can take an unacceptably long time for thermostat 224 to close under these conditions; at times as long or longer as it takes for water to freeze. As a result, the installer may be forced to wait twice the usual time: first to cool thermostat 224 in order to cycle far enough to put water in the mold, and then to freeze the water placed in the mold.

To alleviate this difficulty, the icemaker includes a manual start switch 171 (FIG. 7) which allows the installer to override the normal timing sequence. Manual start switch 171 is a pushbutton which is installed in mounting area 176 of housing 172. Manual start switch 171 is aligned with blades 191 and 199 (which form hold switch 214); when pressed, switch 171 forces blade 191 into blade 199, closing hold switch 214 and thereby turning on motor 146. Thus, when installing a refrigerator or icemaker, if the installer does not hear the water valve open to fill the icemaker, the installer need only press switch 171 for long enough to cycle the icemaker past time 242, causing the icemaker to complete a cycle and fill the mold body.

Installers have encountered the problem discussed above with previous icemaker designs, and have devised a different solution. That solution is to grasp the fingers 113 of ejector bar 112 and manually force a cycle of the icemaker. In the icemaker disclosed herein, doing this would force rotation of cam wheel 142. Triangular slip clutch 182 would bend, allow cam wheel 142 to rotate independently of the 146. This solution is clearly inferior to the use of a manual start switch, in that it not only requires intense manual effort, but also places unnecessary stress on the fingers of the ejector bar 112. Torque applied to the ejector bar to eject ice is distributed among all of the fingers, whereas the above procedure applies all of the torque to one or a few fingers.

While the above method is inferior, it may not be possible to educate installers not to use it. Therefore, the icemaker is configured so that it will not be damaged by the above method. First, the ejector bar fingers are reinforced sufficiently to individually bear enough torque to cause the triangular slip clutch 182 to bend and allow the cam wheel 142 to turn independently of the motor 146. Second, the icemaker is configured to prevent damage to the switch blades when the cam wheel is manually rotated. Specifically, manual rotation of the cam wheel can cause damage to the switch blades if the cam wheel is unintentionally rotated backwards. The cam risers 152, 154, 156, 158 have bevels on their leading edges but not on their trailing edges; therefore, rotating the cam wheel backwards can damage the blades by jamming the blades into the unbevelled trailing edges of the cam risers.

To prevent this kind of damage, the icemaker includes an anti-back mechanism in the gear power train. Specifically, as shown in FIGS. 6 and 7, an anti-back ring 185 is placed around the motor drive pinion 148. This pinion includes a curved end 153 and an uncurved end 155. So long as the cam wheel 142 and pinion 148 are rotated in the correct direction indicated by arrows 157, curved end 153 of ring 185 rides smoothly along the top of the teeth of cam wheel 142. However, if the cam wheel and pinion are forced to rotate in the opposite direction, friction between ring 185 and pinion 148 causes end 155 of ring 185 to rotate into and jam between the teeth of pinion 148 and cam wheel 142, preventing further rotation.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. For example, to reduce noise and possible damage, it may be advantageous to bevel the trailing edges of the cam risers as well as the leading edges, so long as no excessive "bounce" (rapid on/off switching) results. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. An icemaker timing apparatus of the type having one or more switches and a moving timer for actuating said switches to operate electrical components of the icemaker, said icemaker timing apparatus comprising a first switch comprising:

a first switch blade;

a second switch blade positioned near to said first switch blade; and a connector mounted on said moving timer and configured, at a predetermined position of said moving timer, to simultaneously electrically contact said first and second switch blades and create an electrical connection therebetween for a predetermined duration of time; and said icemaker timing apparatus further comprising a first cam for actuating said first switch blade toward and away from said second switch blade.

2. The icemaker timing apparatus of claim 1, further comprising a second switch comprising a third switch blade and a fourth switch blade positioned opposite said third switch blade to permit actuation of said third and fourth switch blades into contact and thereby close said second switch;

a second cam for actuating said third switch blade toward and away from said fourth switch blade; and a third cam for actuating said fourth switch blade toward and away from said third switch blade;

said second switch being opened and closed by dual action of said second cam and said third cam.

3. The timing apparatus of claim 2 wherein:

said second cam is mounted on said moving timer, said moving timer is driven by a timing motor to establish timing intervals for electrical switching within said icemaker;

said second switch connects and disconnects electrical power to and from said motor; and said third cam is driven by a feeler bar which extends into an ice storage area to determine if said storage area is full.

4. The icemaker timing apparatus of claim 2 wherein said third and fourth switch blades are mounted with different respective pivot points, such that a distance along said third switch blade between its pivot point and area of contact with said fourth switch blade, is substantially different than a distance along said fourth switch blade between its pivot point and area of contact with said third switch blade;

whereby actuation of said third switch blade into said fourth switch blade causes different resilient movement of said switch blades, creating wiping contact between said switch blades.

5. The icemaker timing apparatus of claim 2 further comprising a third, motor switch which connects and disconnects electrical power to and from a timing motor driving said moving timer, said third switch comprising a fifth switch blade and a sixth switch blade positioned near to said fifth switch blade, and further comprising a manual start button for manually moving said fifth switch blade into contact with said sixth switch blade thereby connecting electrical power to said motor.

6. The icemaker timing apparatus of claim 5 wherein said third and fourth switch blades are mounted with different respective pivot points, such that a distance along said third switch blade between its pivot point and area of contact with said fourth switch blade, is substantially different than a distance along said fourth switch blade between its pivot point and area of contact with said third switch blade;

whereby actuation of said third switch blade into said fourth switch blade causes different resilient movement of said switch blades, creating wiping contact between said switch blades.

7. The icemaker timing apparatus of claim 1 wherein motion of said first switch blade by said first cam changes the predetermined position at which said connector simultaneously electrically contacts said first and second switch blades.

8. The icemaker timing apparatus of claim 1 wherein motion of said first switch blade by said first cam changes the predetermined duration of time for which said connector simultaneously electrically contacts said first and second switch blades.

9. The icemaker timing apparatus of claim 8 wherein said first switch is a water fill switch coupled to a water valve for admitting water into a mold body of said icemaker, and said first cam is a manually-variable ice cube size adjustment.

10. The icemaker timing apparatus of claim 1 further comprising a second switch comprising a third switch blade and a fourth switch blade positioned opposite said third switch blade to permit actuation of said third and fourth switch blades to create contact between said third and fourth switch blades and thereby close said second switch; wherein said third and fourth switch blades are mounted with different respective pivot points, such that a distance along said third switch blade between its pivot point and area of contact with said fourth switch blade, is substantially different than a distance along said fourth switch blade between its pivot point and area of contact with said third switch blade whereby actuation of said third switch blade into said fourth switch blade causes different resilient movement of said switch blades, creating wiping contact between said switch blades.

11. The icemaker timing apparatus of claim 1 further comprising a second, motor switch which connects and disconnects electrical power to and from a timing motor driving said moving timer, said second switch comprising a third switch blade and a fourth switch blade positioned near to said third switch blade, and further comprising a manual start button for manually moving said third switch blade into contact with said fourth switch blade thereby connecting electrical power to said motor.

12. The icemaker timing apparatus of claim 11 wherein said third and fourth switch blades are mounted with different respective pivot points, such that a distance along said third switch blade between its pivot point and area of contact with said fourth switch blade, is substantially different than a distance along said fourth switch blade between its pivot point and area of contact with said third switch blade;

whereby actuation of said third switch blade into said fourth switch blade causes different resilient movement of said third and fourth switch blades, creating wiping contact between said third and fourth switch blades.

13. An icemaker timing apparatus of the type having one or more switches and one or more cams for actuating said switches to operate electrical components of an icemaker, comprising:

a first switch blade mounted such that a length of said first switch blade is free to resiliently move;

a second switch blade mounted opposite said first switch blade such that a length of said second switch blade is free to resiliently move, to permit actuation of said first switch blade into said second switch blade to create contact between a contact area of said second switch blade and a contact area of said first switch blade;

a first cam mounted for actuation of said first switch blade into said second switch blade to cause contact between said contact areas of said switch blades;

wherein said first and second switch blades are mounted with different respective pivot points, such that a distance along said first switch blade between its pivot point and area of contact with said second switch blade, is substantially different than a distance along said second switch blade between its pivot point and area of contact with said first switch blade;

whereby actuation of said first switch blade into said second switch blade by said first cam causes different resilient movement of said switch blades, creating wiping contact between said contact areas of said switch blades.

14. The icemaker timing apparatus of claim 13 wherein:

said first and second switch blades form a motor switch which connects and disconnects electrical power to and from a timing motor; and further comprising:

a manual start button for manually moving said first switch blade into contact with said second switch blade thereby closing said motor switch and connecting electrical power to said motor.

15. The icemaker timing apparatus of claim 13, further comprising a third switch blade and a fourth switch blade positioned opposite said third switch blade to permit actuation of said third and fourth switch blades to create contact between said blades;

a second cam for actuating said third switch blade toward and away from said fourth switch blade; and a third cam for actuating said fourth switch blade toward and away from said third switch blade;

said third and fourth switch blades being opened and closed by dual action of said second cam and said third cam.

16. An icemaker timing apparatus of the type having one or more switches and a moving timer with one or more cams for actuating said switches to operate electrical components of an icemaker, comprising a motor switch connecting and disconnecting electrical power to and from a motor driving said moving timer, comprising first and second switch blades mounted with different respective pivot points, such that a distance along said first switch blade between its pivot point and area of contact with said second switch blade, is substantially different than a distance along said second switch blade between its pivot point and area of contact with said first switch blade;

a first cam mounted to said moving timer for actuating said first switch blade into said second switch blade to connect electrical power to said motor at selected positions of said moving timer;

a manual start button for manually moving said first and second switch blades of said motor switch into contact to connect electrical power to said motor regardless of the position of said moving timer; and a water fill control for opening and closing a water fill valve for filling an ice mold in said icemaker, said water fill control comprising: first and second electrical contacts positioned near to each other, a connector mounted on said moving timer and configured, at a predetermined position of said moving timer, to simultaneously electrically contact said first and second contacts and create an electrical connection therebetween for a predetermined duration of time, and a second cam for actuating said contacts toward and away from each other to change the duration of electrical contact between said contacts by said connector and thereby vary an amount of water admitted to said mold by said valve.

17. An icemaker timing apparatus of the type having one or more switches and a moving timer having one or more cams for actuating said switches to operate electrical components of an icemaker, comprising:

a motor driving said moving timer;

a motor switch connecting and disconnecting electrical power to and from said motor, comprising a first switch blade mounted such that a length of said first switch blade is free to resiliently move, and a second switch blade mounted opposite said first switch blade, to permit actuation of said first switch blade into said second switch blade to create contact between a contact area of said second switch blade and said contact area of said first switch blade and thereby close said switch;

a first cam mounted on said moving timer for actuation of said first switch blade into said second switch blade to cause contact between said contact areas of said switch blades at selected positions of said moving timer; and a manual start button for manually moving said first and second switch blades of said motor switch into contact to connect electrical power to said motor regardless of the position of said moving timer.

18. The icemaker timing apparatus of claim 17 further comprising a second switch comprising a third switch blade and a fourth switch blade positioned opposite said third switch blade to permit actuation of said third and fourth switch blades to create contact between said blades and thereby close said second switch;

a second cam mounted on said moving timer for actuating said third switch blade toward and away from said fourth switch blade; and a third cam for actuating said fourth switch blade toward and away from said third switch blade;

said second switch being opened and closed by dual action of said second cam and said third cam.

19. The icemaker timing apparatus of claim 18 wherein said third and fourth switch blades are mounted with different respective pivot points, such that a distance along said third switch blade between its pivot point and area of contact with said fourth switch blade, is substantially different than a distance along said fourth switch blade between its pivot point and area of contact with said third switch blade;

whereby actuation of said third switch blade into said fourth switch blade by said second cam causes different resilient movement of said third and fourth switch blades, creating wiping contact between said third and fourth switch blades.

* * * * *

UNITED STATES PATENT AND TRADEMARK OFFICE

CERTIFICATE OF CORRECTION

PATENT NO. : 5,596,182

DATED : January 21, 1997

INVENTOR(S) : Edwards et al.

It is certified that error appears in the above-identified patent and that said Letters Patent is hereby corrected as shown below:

Column 2, line 64, after "Fig. 8A", add --is--.

Column 3, line 34, replace "its" with --it--.

Column 4, line 41, replace "cycles" with --cycle--.

Column 5, line 40, replace "cams" with --cam--.

Column 9, line 20, replace "has" with --have--.

Column 9, line 21, replace "it does" with --do--.

Signed and Sealed this

Eighteenth Day of November 1997

*Attest:*

*Attesting Officer*

Bruce Lehman

BRUCE LEHMAN

*Commissioner of Patents and Trademarks*